United States Patent [19]

Steinhauer et al.

[11] Patent Number: 4,697,603

[45] Date of Patent: Oct. 6, 1987

[54] APPARATUS FOR BUILDING A STREAM OF FIBROUS MATERIAL

[75] Inventors: Jürgen Steinhauer, Glinde; Wolfgang Steiniger, Börnsen, both of Fed. Rep. of Germany

[73] Assignee: Hauni-Werke Körber & Co. KG, Hamburg, Fed. Rep. of Germany

[21] Appl. No.: 841,447

[22] Filed: Mar. 19, 1986

[30] Foreign Application Priority Data

Mar. 19, 1985 [DE] Fed. Rep. of Germany ..... 3509814

[51] Int. Cl.[4] ..... A24C 5/14

[52] U.S. Cl. ..... 131/84.4; 131/84.1; 131/108

[58] Field of Search ..... 131/84.1, 84.2, 84.3, 131/84.4, 108

[56] References Cited

U.S. PATENT DOCUMENTS

| | | | |
|---|---|---|---|
| 4,009,722 | 3/1977 | Wahle et al. | 131/39 |
| 4,220,164 | 9/1980 | Lorenzen | 131/84.1 |
| 4,373,538 | 2/1983 | Steiniger | 131/109.1 |
| 4,463,768 | 8/1984 | Quarella | 131/84.3 |
| 4,485,826 | 12/1984 | Holzangel | 131/84.4 |
| 4,564,028 | 1/1986 | Heitmann | 131/84.4 |

FOREIGN PATENT DOCUMENTS

| | | | |
|---|---|---|---|
| 2134367 | 8/1984 | United Kingdom | 131/84.4 |

*Primary Examiner*—V. Millin

*Attorney, Agent, or Firm*—Peter K. Kontler

[57] ABSTRACT

The distributor of a cigarette rod making machine delivers particles of tobacco into a stream building zone wherein the particles are accumulated into a continuous stream. The surplus of tobacco is removed by an adjustable trimming device and the removed surplus is transported back to the distributor for reuse. The quantity of removed surplus is measured by a weighing device whose transducer transmits signals which are compared with signals denoting the position of the trimming device, and the resulting signals are used to adjust the rate of delivery of tobacco particles to the stream building zone. The weighing device has a frame which carries two pulleys for an endless belt. The frame can pivot about the axis of one of the pulleys or it can be tiltably mounted on a fulcrum between the two pulleys.

8 Claims, 3 Drawing Figures

Fig.1

APPARATUS FOR BUILDING A STREAM OF FIBROUS MATERIAL

BACKGROUND OF THE INVENTION

This invention relates to apparatus for building a stream of fibrous material, and more particularly to improvements in apparatus which can be used with advantage in cigarette makers to form a continuous stream of comminuted tobacco leaves, substitute tobacco and/or reconstituted tobacco.

A tobacco stream is formed by drawing fragments of tobacco leaves from a magazine or another suitable source which is provided in or forms part of a distributor. The latter has means for delivering tobacco particles to one elongated reach of a foraminous belt conveyor to which the particles of tobacco are attracted by suction. The stream is thereupon trimmed to remove the surplus, and the resulting equalized stream is draped into a web of cigarette paper or other suitable wrapping material. The removed surplus is returned to the magazine of the distributor for readmission into the stream building zone.

It is further known to monitor the quantity of removed fibrous material prior to reintroduction into the distributor. Reference may be had to the published British patent application Serial No. 2 134 367 which discloses a plate-like deflector for the removed surplus. A drawback of monitoring means which is disclosed in the British application is that it does not furnish reliable signals as well as that the signals are too weak for satisfactory processing, e.g., to regulate the operation of the distributor in such a way that the quantity of the removed surplus can be held to a minimum.

OBJECTS AND SUMMARY OF THE INVENTION

An object of the invention is to provide an apparatus wherein the quantity of removed excess of fibrous material is ascertained in a novel and improved way.

Another object of the invention is to provide the apparatus with novel and improved means for conveying the removed surplus from the stream building zone to the distributor of a cigarette maker or a like machine.

A further object of the invention is to provide novel and improved means for generating signals which denote the quantity of removed fibrous material.

An additional object of the invention is to provide the apparatus with novel and improved means for evaluating the signals which denote the quantity of removed fibrous material.

Another object of the invention is to provide an apparatus which can generate reliable signals denoting the quantity of removed fibrous material and which can process such signals in an optimum way in order to economize with fibrous material and to reduce the likelihood of unnecessary circulation of substantial quantities of the surplus in the machine.

Still another object of the invention is to provide a novel and improved method of regulating the quantity of fibrous material which is removed from a continuous stream of such material in a cigarette making of like machine.

A further object of the invention is to provide a novel and improved method of forming a continuous stream from fragmentized tobacco leaves and/or other smokable material.

The invention is embodied in an apparatus for forming a stream of fibrous material, such as tobacco. The apparatus comprises a distributor having a source of fibrous material, means defining a stream building zone and means for feeding fibrous material from the source to the stream building zone wherein the material accumulates into a continuous stream normally containing a surplus of fibrous material. The apparatus further comprises an adjustable trimming device or analogous means for removing the surplus from the stream, means for returning the removed surplus to the source of the distributor, and signal generating means for monitoring the quantity of the removed surplus. In accordance with a feature of the invention, such monitoring means comprises a weighing device for fibrous material.

In accordance with one presently preferred embodiment of the invention, the weighing device comprises a first pulley, sprocket wheel, gear or an analogous rotary element which is rotatable about a fixed axis, a support which is pivotable about the fixed axis, a second rotary element on the support, endless belt or chain conveyor means trained over the rotary elements and serving to advance the removed surplus in a direction from the first toward the second rotary element, and suitable transducer means (e.g., a pressure-responsive transducer) which is arranged to generate signals denoting fluctuations of the weight of fibrous material on the conveyor means between the two rotary elements. The transducer means is or can be adjacent to the second rotary element. Such apparatus further comprises a motor or other suitable means for driving the first rotary element.

In accordance with another presently preferred embodiment of the invention, the weighing device comprises a support, a first and a second pulley, gear, sprocket wheel or analogous rotary element mounted on the support, endless chain or belt conveyor means trained over the rotary elements and arranged to advance the removed surplus in a direction from the first toward the second rotary element, a fulcrum tiltably carrying the support and disposed intermediate the two rotary elements, and transducer means (e.g., a pressure-responsive transducer) arranged to generate signals denoting the extent of tilting of the support. Such weighing device preferably further comprises a counterweight or other suitable means for maintaining the support in a neutral position in the absence of fibrous material on the conveyor means, i.e., the counterweight balances the mass of those parts of the weighing device which would tend to tilt the support from its neutral position.

The removing means is movable with reference to the stream building zone (e.g., up and down if the stream building zone is substantially horizontal), and the apparatus further comprises a signal generating device (e.g., a level detector) which monitors the position of the removing means relative to the stream building zone, a signal comparing circuit which generates signals denoting the difference between the intensities and/or other characteristics of signals from the monitoring means and monitoring device, and means (e.g., a servomotor) for adjusting the feeding means in response to signals from the signal comparing circuit. Such apparatus preferably further comprises a signal generating arrangement (preferably a density measuring device) which monitors a variable characteristic of the stream downstream of the removing means and means for adjusting the removing means in response to signals from such arrangement.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
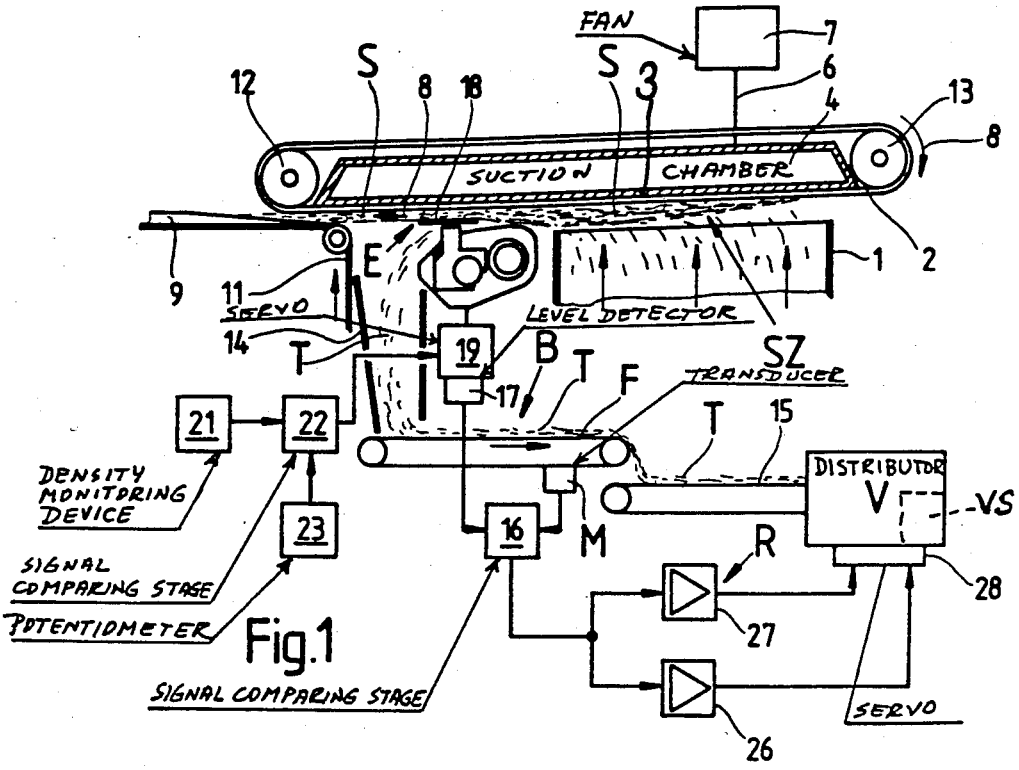
FIG. 1 is a schematic partly elevational and partly sectional view of a portion of a cigarette making machine which embodies one form of the improved apparatus.

The apparatus which is shown in FIG. 1 forms part of a cigarette making machine, e.g., a machine known as PROTOS which is manufactured and distributed by the assignee of the present application. The apparatus comprises a distributor V (also known as hopper) which may be of the type VE 80 used in the PROTOS machine. A detailed description of a distributor which can be used in the apparatus of the present invention is disclosed in commonly owned U.S. Pat. No. 4,373,538 granted Feb. 15, 1983 to Steiniger or in commonly owned U.S. Pat. No. 4,463,768 granted Aug. 7, 1984 to Quarella. The distributor V comprises a magazine or another suitable source VS of comminuted tobacco leaves and/or other smokable fibrous material, and adjustable means for feeding fibrous material from the source VS to a stream building zone SZ which is defined by the lower reach of an endless foraminous belt conveyor 2 in conjunction with a suction chamber 4. The suction chamber 4 has a perforated bottom wall 3 which is adjacent to the upper side of the lower reach of the conveyor 2 and enables the suction chamber to attract fibrous material to the underside of the lower reach so that the particles of tobacco leaves and/or other smokable material accumulate into a continuous tobacco stream S which advances in the direction indicated by arrows 8. The suction chamber 4 is connected with the intake end of a fan 7 or another suitable suction generating device by a conduit 6. The conveyor 2 is trained over several pulleys 12, 13 one of which is driven (the motor is not shown) so as to advance the lower reach of the conveyor 2 along the upper end of a duct 1 and to the left beyond the stream building zone SZ. The duct 1 is one element of the means for feeding fibrous material from the magazine VS to the stream building zone Z.

The conveyor 2 advances the fully grown stream S past a conventional trimming or equalizing device E which removes the surplus (T) of fibrous material so that the equalized stream which advances beyond the trimming station is ready for draping into a web 11 of cigarette paper or other suitable wrapping material. The wrapping device 9 is of conventional design; reference may be had to commonly owned U.S. Pat. No. 4,009,722 granted Mar. 1, 1977 to Wahle et al. The trimming device E may be of the type disclosed in commonly owned U.S. Pat. No. 4,485,826 granted Dec. 4, 1984 to Holznagel or in commonly owned U.S. Pat. No. 4,564,028 granted Jan. 14, 1986 to Heitmann. As disclosed in these patents, the trimming device comprises two coplanar discs whose marginal portions clamp the fibrous material at a certain level below the lower reach of the conveyor 2, and a cutting tool, paddle wheel, brush or a like surplus removing member which rotates at a level below the plane of the discs to remove fibrous material extending downwardly below such plane. The manner in which the cigarette rod which is obtained in response to draping of the web 11 around the equalized stream S) is severed in a cutoff to yield a series of discrete plain cigarettes of unit length or multiple unit length is known and need not be described here.

The apparatus further comprises a reversible servomotor 19 or other suitable means for adjusting the position (level) of the trimming device E with reference to the stream building zone SZ (i.e., with reference to the lower reach of the conveyor 2) so as to change the quantity of the surplus T which is removed by the rotary surplus removing member of the trimming device. The servomotor 19 preferably carries a signal generating device 17 (e.g., a conventional level detector which is used in existing cigarette makers) serving to generate signals denoting the momentary level of the trimming device E.

The surplus T of fibrous material which is removed by the trimming device E descends by gravity into a funnel 14 forming part of a means for returning the surplus into the magazine VS of the distributor V for recirculation into the stream building zone SZ. The returning means further comprises an endless belt conveyor F and an additional belt conveyor 15. The conveyor F receives the surplus T from the outlet of the funnel 14 and its discharge end EB (see FIG. 2) delivers the stream of surplus material onto the upper reach of the conveyor 15 for transport into the distributor V. The returned surplus T is preferably admixed to fresh fibrous material in a manner as fully described in the aforementioned patent to Steiniger.

In accordance with a feature of the invention, the quantity of surplus material T between the trimming device E and the distributor V is monitored by an assembly which includes a weighing device B, and such weighing device includes the aforementioned endless belt conveyor F of the surplus returning means 14, F, 15. The weighing device B comprises a signal generating monitoring device M in the form of a transducer which is responsive to changes in the weight of a frame-like support 32 (FIG. 2) for the conveyor F and generates electric signals which are transmitted to the corresponding input of a signal comparing circuit 16. Another input of the circuit 16 receives electric signals from the level monitoring device 17. The signals from the transducer M and from the level monitoring device 17 are compared and the circuit 16 transmits signals whose intensity and/or another characteristic is indicative of the difference between the intensities of the received signals. The output of the circuit 16 can transmit positive signals to a first amplifier 26 or negative signals to a second amplifier 27. These amplifiers constitute two elements of a control circuit R which further includes a reversible servomotor 28 or other suitable means for adjusting the means for feeding fibrous material from the magazine VS to the stream building zone SZ in response to signals from the output of the signal comparing circuit 16. Signals from the level detector 17 constitute reference signals, i.e., the circuit 16 compares such reference signals with the signals which are transmitted by the transducer M, and the output of the circuit 16 transmits a positive signal to the amplifier 27 when the quantity of surplus T on the upper reach of the endless belt F of the weighing device B exceeds a value which is a function of the momentary level of the trimming device E. The output of the circuit 16 transmits signals to the amplifier 26 when the quantity of fibrous material (surplus T) on the conveyor F is below such value.

The apparatus of FIG. 1 further comprises a signal generating arrangement including a conventional density monitoring device 21 which ascertains the density of the equalized stream S downstream of the trimming device E and whose output transmits corresponding signals to one input of a signal comparing stage 22. The other input of the stage 22 receives signals from an adjustable source 23 of reference signals (e.g., an adjustable potentiometer) denoting the desired density of the equalized stream S. The output of the signal comparing stage 22 transmits signals to the servomotor 19 which changes the level of the trimming device E when the characteristics of signals at the two inputs of the stage 22 deviate from each other beyond a permissible extent. The density monitoring device 21 can comprise a source of corpuscular radiation at one side of the equalized stream and an ionization chamber at the other side of the equalized stream opposite the radiation source. Suitable density monitoring devices are manufactured and sold by the assignee of the present application.

The servomotor 28 is arranged to drive its output element in a first direction in response to signals from the amplifier 26 and in a second direction, counter to the first direction, in response to signals from the amplifier 27. The manner in which the servomotor 28 regulates the rate of feed of fibrous material from the magazine VS to the stream building zone SZ may be identical to that described in the aforementioned published British patent application No. 2 134 367.

Figure 2:
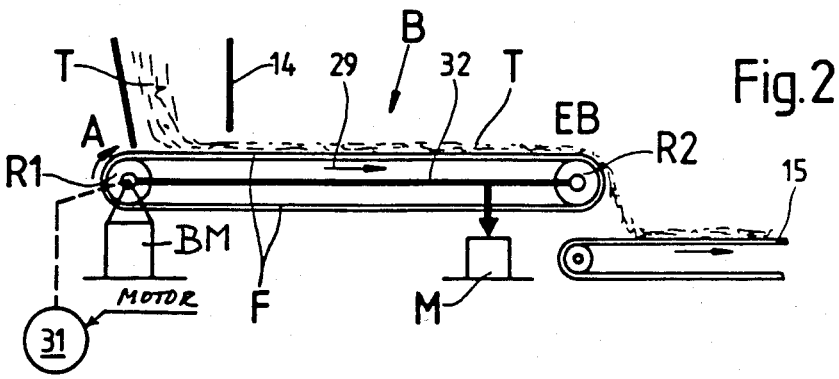
FIG. 2 is an enlarged view of the weighing device in the apparatus of FIG. 1.

FIG. 2 illustrates the details of the weighing device B which is used in the apparatus of FIG. 1. The device B includes a first rotary element R1 in the form of a toothed or smooth-surfaced pulley which is rotatable in the frame of the cigarette making machine about a fixed axis defined by a bearing member BM, an electric motor 31 or another suitable prime mover which drives the pulley R1 in the direction of arrow A, the aforementioned frame-like support 32 which is pivotable about the axis of the pulley R1, a second rotary element in the form of a toothed or smooth-surfaced pulley R2 which is mounted on the support 32 and is remote from the pulley R1, the aforementioned belt conveyor F which is trained over the pulleys R1, R2 so that its upper reach receives the surplus T in the region of the pulley R1 and advances the stream of surplus toward the pulley R2 and beyond the discharge end EB, and the aforementioned pressure-responsive transducer M which is disposed at a level below the support 32 adjacent to the pulley R2 to generate electric signals whose intensity and/or another characteristic is indicative of the weight of the mass of fibrous material on the upper reach of the conveyor F. The direction in which the surplus T is transported by the conveyor F is indicated by an arrow 29. The variations of pressure which the support 32 applies to the input element of the transducer M are proportional to fluctuations of the weight of the mass of fibrous material on the upper reach of the conveyor F. The transducer M can employ one or more pressure-sensitive semiconductors, expandible strip-shaped input elements, an inductance, an electric or electronic scale or any other suitable means for generating signals which are indicative of the weight of the pivotable support 32 and of the parts and fibers on such support. The discharge end EB of the conveyor F delivers successive increments of the stream of surplus fibrous material onto the upper reach of the conveyor 15.

Figure 3:
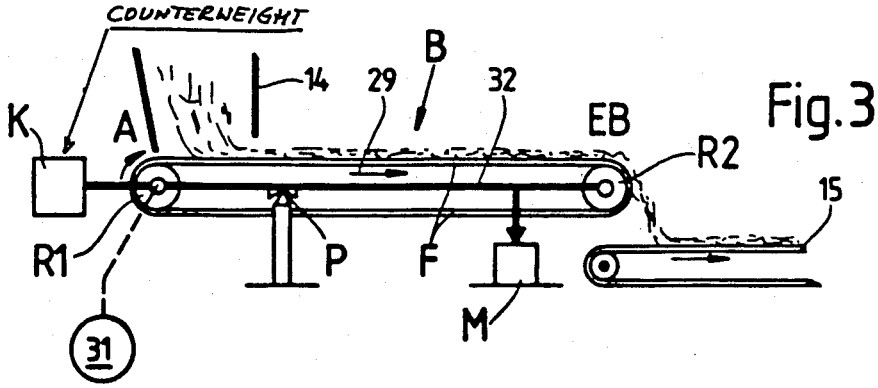
FIG. 3 is a similar view of a modified weighing device.

FIG. 3 shows a modified weighing device B wherein all such parts which are identical with or clearly analogous to the corresponding parts of the weighing device of FIGS. 1 and 2 are denoted by similar reference characters. The main difference between the two weighing devices is that the support 32 of the device B of FIG. 3 is tiltably mounted on a fixed fulcrum P which is mounted in the frame of the cigarette making machine, and that the left-hand portion or arm of the support 32 carries a counterweight K which ensures that the support is maintained in a neutral position (preferably in a substantially horizontal position) when the upper reach of the conveyor F does not carry any fibrous material. The transducer M is disposed below the right-hand arm of the support 32 (i.e., to the right of the fulcrum P) and generates signals which are indicative of the mass or weight of the surplus of fibrous material carried by the upper reach of the conveyor F.

The mode of operation of the improved apparatus is as follows:

The duct 1 of the feeding means delivers a shower of fibrous material to the underside of the lower reach of the conveyor 2 in the stream building zone SZ whereby the admitted fibrous material forms a growing stream because it is attracted to the conveyor 2 by the pressure differential which is established by the suction chamber 4 through the pores or holes of the perforated bottom wall 3. The growing stream S advances in the direction of the arrow 8 and successive increments of the fully grown stream are equalized by the trimming device E so that the wrapping mechanism 9 receives and treats a rod-like filler whose density is normally constant and matches a preselected value as denoted by signals from the source 23. The mechanism 9 drapes the web 11 around the filler to form a cigarette rod which is severed at predetermined intervals to yield a series of plain cigarettes of unit length or multiple unit length. Such plain cigarettes can be admitted into a packing machine or into a filter tipping machine, e.g., a machine known as MAX or MAX S (both manufactured by the assignee of the present application).

The surplus T which is removed by the rotary member of the trimming device E descends into the funnel 14 and is caused to deposit on the conveyor F of the weighing device B. The conveyor F delivers successive increments of the stream of surplus fibrous material to the conveyor 15 which returns the material into the magazine VS of the distributor V for reintroduction into the duct 1. As mentioned above, the returned surplus is mixed with fresh fibrous material prior to reentering the duct 1 and the stream building zone SZ.

The density monitoring device 21 ascertains the density of successive increments of the equalized stream (filler) S and transmits signals to the stage 22 wherein such signals are compared with signals from the source 23 of reference signals. If the density of the filler is less than desired, the stage 22 transmits a signal which causes the servomotor 19 to lower the trimming device E, i.e., to ensure that the equalized stream contains a larger quantity of fibrous material per unit length. Inversely, the signal from the stage 22 entails a lifting of the trimming device E toward the lower reach of the conveyor 2 if the density of the filler is excessive, i.e., if the intensity of the signal from the monitoring device 21 exceeds the intensity of the reference signal from the source 23.

It is preferred to maintain the discs of the trimming device E at a predetermined (optimum) level, i.e., signals from the signal comparing stage 22 are used to change the level of the trimming device E (so that such level deviates from the standard or optimum level) only if the density of the filler cannot be altered in another way. The trimming device E is returned to its optimum level by influencing the surplus T which is removed by the trimming device downstream of the stream building zone SZ. The arrangement is such that, if the density of the filler is too low, the quantity of the removed surplus T is increased. This is effected by the control circuit R whose servomotor 28 receives a signal denoting the difference between the intensities of reference signal from the level detector 17 and actual-value signal from the transducer M. The signal from the transducer M is indicative of the average mass of the stream of surplus (T) of fibrous material which is being returned into the magazine VS of the distributor V. The intensity of the signal from the level detector 17 increases in response to downward movement of the trimming device E (under the action of the servomotor 19 and in response to detection of unsatisfactory density per unit length of the filler downstream of the equalizing station). The amplifier 26 then receives a positive signal from the output of the signal comparing circuit 16 to induce the feeding unit of the distributor V to increase the rate of feed of fibrous material to the stream building zone Z. The rate of feed is increased until the signal from the transducer M reaches an intensity corresponding to that of the signal from the level detector 17. By increasing the rate of feed of fibrous material, the feeding unit of the distributor V causes the formation of a stream which contains more tobacco, and a larger percentage of such material advances beyond the equalizing station so that the intensity of the signal from the density monitoring device 21 changes and entails a movement of the trimming device E toward the lower reach of the conveyor 2, i.e., toward the optimum level.

The operation of the circuit R is changed if the signal from the monitoring device 21 indicates that the density of the filler is excessive and the trimming device E is caused to rise above its optimum level. The amplifier 27 then transmits a signal which causes the servomotor 28 to reduce the rate of admission of fibrous material into the stream building zone SZ. This entails a reduction of the density of the filler which is monitored by the device 21, and the servomotor 19 is caused to move the trimming device E downwardly toward or all the way to the optimum level. The mass of the surplus T per unit length of the stream on the conveyor F is reduced in response to a reduction of the rate of feed of fibrous material to the underside of the conveyor 2. The transducer M of the weighing device B detects such reduction of the quantity of the surplus and transmits an appropriate signal to the signal comparing stage 16. The rate of admission of fibrous material into the zone SZ is reduced until the signal from the transducer M matches the reference signal from the level detector 17.

It will be noted that the monitoring means 21, 17 and M cooperate to maintain the trimming device E at or close to its optimum level. The trend is toward a movement of the trimming device E to such level. a rule, the level of the trimming device E is changed only for a short interval of time so as to compensate for appreciable deviations (fluctuations) of the density of the filler from an optimum value which is selected by the source 23 of reference signals. The level detector 17 thereupon cooperates with the transducer M to ensure that the trimming device E is rapidly returned to the optimum level, i.e., at a predetermined distance from the underside of the lower reach of the conveyor 2.

The servomotor 28 can be used to directly drive one or more rotary conveyors for fibrous material at any one of several different speeds. Such conveyors are installed in the distributor V. Alternatively, the servomotor 28 can (directly or indirectly) change the ratio of the speed or speeds of one or more conveyors relative to one or more additional conveyors to thus increase or reduce the rate of feed of fibrous material into the duct 1.

U.S. Pat. No. 4,220,164 granted Sept. 2, 1980 to Lorenzen discloses a weighing device which is disposed in the path of travel of surplus tobacco between the magazine and a gathering duct in the distributor of a cigarette making machine. The weighing device of this patent generates signals which are indicative of the mass of the mixture of fresh fibrous material and the recirculated surplus of fibrous material on the way of such mixture from the magazine toward the stream building zone. This weighing device is not designed to and cannot ascertain the mass of fibrous material which is removed from an unequalized stream in a cigarette maker. Moreover, signals which are generated by such weighing device cannot influence the mass of fibrous material which is being returned to the magazine of the distributor.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for forming a stream of fibrous material, such as tobacco, comprising a source of fibrous material; means defining a stream building zone; adjustable means for feeding fibrous material from said source to said zone wherein the material accumulates into a continuous stream containing a surplus of material; adjustable means for removing the surplus from the stream, said removing means being movable with reference to said zone; a signal generating device for monitoring the position of said removing means relative to said zone; means for returning the removed surplus to said source; signal generating means for monitoring the quantity of the removed surplus, including a weighing device for fibrous material; signal comparing means for generating signals denoting the difference between the signals from said monitoring means and said monitoring device; and means for adjusting said feeding means in response to signals from said signal comparing means.

2. The apparatus of claim 1, wherein said weighing device comprises a first rotary element rotatable about a fixed axis, a support pivotable about said axis, a second rotary element on said support, endless conveyor means trained over said elements and arranged to advance the removed surplus in a direction from said first toward said second element, and transducer means arranged to generate signals denoting the fluctuations of the weight of fibrous material on said conveyor means.

3. The apparatus of claim 2, wherein said transducer means is adjacent said second rotary element.

4. The apparatus of claim 2, further comprising means for driving said first rotary element.

5. The apparatus of claim 1, wherein said weighing device comprises a support, a first and a second rotary element on said support, endless conveyor means trained over said elements and arranged to advance the removed surplus in a direction from said first toward said second element, a fulcrum tiltably carrying said support and disposed intermediate said rotary elements, and transducer means arranged to generate signals denoting the extent of tilting of said support.

6. The apparatus of claim 5, further comprising means for maintaining said support in a neutral position in the absence of fibrous material on said conveyor means.

7. The apparatus of claim 1, further comprising a signal generating arrangement for monitoring a variable characteristic of the stream and means for adjusting said removing means in response to signals from said arrangement.

8. The apparatus of claim 7, wherein said arrangement includes means for monitoring the density of the stream.

* * * * *